United States Patent [19]

Zdenek

[11] Patent Number: 4,534,834

[45] Date of Patent: Aug. 13, 1985

[54] PROCESS FOR CONTINUOUS PRETREATMENT BY ELECTROCHEMICAL OXIDATION OF STRIP OR FOIL OF ALUMINUM

[75] Inventor: Maly Zdenek, Kreuzlingen, Switzerland

[73] Assignee: Swiss Aluminium Ltd., Chippis, Switzerland

[21] Appl. No.: 628,755

[22] Filed: Jul. 9, 1984

[30] Foreign Application Priority Data

Jul. 14, 1983 [CH] Switzerland ..... 3860/83

[51] Int. Cl.[3] ..... C25D 5/02; C25D 11/08

[52] U.S. Cl. ..... 204/28; 204/38.3; 204/38.7; 204/DIG. 9; 204/228

[58] Field of Search ..... 204/15, 28, 38 A, 58, 204/228, 231

[56] References Cited

U.S. PATENT DOCUMENTS

| | | | |
|---|---|---|---|
| 2,951,025 | 8/1960 | Mostovych et al. | 204/28 |
| 3,632,486 | 1/1972 | Hermann | 204/28 |
| 3,766,093 | 10/1973 | Hermann et al. | 204/28 |
| 3,983,014 | 9/1976 | Newman et al. | 204/58 |
| 4,014,758 | 3/1977 | Kawai et al. | 204/28 |
| 4,131,518 | 12/1978 | Fromson | 204/15 |
| 4,214,961 | 7/1980 | Anthony | 204/28 |
| 4,226,680 | 10/1980 | Cooke et al. | 204/58 |

FOREIGN PATENT DOCUMENTS

| | | | |
|---|---|---|---|
| 0654299 | 12/1962 | Canada | 204/58 |
| 0075628 | 6/1977 | Japan | 204/28 |
| 0001253 | 1/1979 | Japan | 204/58 |
| 1539341 | 1/1979 | United Kingdom | 204/28 |

*Primary Examiner*—Howard S. Williams
*Assistant Examiner*—Terryence Chapman
*Attorney, Agent, or Firm*—Bachman and LaPointe

[57] ABSTRACT

Pretreatment of aluminum strip or foil (40) for lacquering, adhesive coating or laminating processes involves heavy metal compounds which are considered undesirable for many packaging purposes, in particular for foodstuff packaging. These disadvantages are avoided if the strip or foil is pretreated in an electrolyte by subjecting it to a three phase alternating current of which one phase is rectified and the side of the strip or foil to be treated is made to pass in sequence three electrodes of which at least one is connected to the rectified phase while the others are connected to the other phase of the alternating current. Such a pretreatment has the advantage over an alternating current treatment that the oxide layers offer high strength of adhesion and the treatment can be performed faster.

14 Claims, 4 Drawing Figures

PROCESS FOR CONTINUOUS PRETREATMENT BY ELECTROCHEMICAL OXIDATION OF STRIP OR FOIL OF ALUMINUM

BACKGROUND OF THE INVENTION

The invention relates to the pretreatment by electrochemical oxidation of strip or foil of aluminum, for lacquering, adhesive coating or laminating processes.

Lacquered strips or foils made of aluminum are employed for the manufacture of foodstuff packaging materials, the lacquer providing corrosion protection for the metal. For many packaging purposes it suffices for the lacquer to be deposited on the untreated aluminum. For more demanding forms of packaging, such as deep drawn containers for pasteurized or sterilized goods, however, it is necessary to pretreat the aluminum in order to achieve adequate adhesion of the lacquer.

It is known to pretreat of aluminum strip or foil whereby chemical conversion of the aluminum takes place. Usually such reactions are carried out in baths containing chromic acid, fluoric acid or phosphoric acid. When chromic acid is used for this purpose, the newly formed layer contains hexavalent chromium compounds which are increasingly regarded as unacceptable in foodstuff packaging. In view of this, non-electrolytic methods for producing $Cr^{VI}$-free protective coatings have already been developed. The quality of such coatings is, however, inadequate with respect to both lacquer adhesion and corrosion resistance especially for sterilizable forms of packaging.

German Pat. DE-PS No. 17 71 057 reveals a continuous pretreatment process for aluminum strip prior to coating the same with lacquer wherein the strip is passed through an aqueous, sulphuric acid bath, which is at a temperature of 80°–100° C. and features electrodes which enable the strip to be anodized under the application of alternating current. The facilities for carrying out this process comprise two counter electrodes which are separate and are insulated from the bath. These electrodes are connected to an alternating current source and are immersed in the sulphuric acid electrolyte. The metal strip passing through the electrolyte is given, by the electrodes and corresponding to the frequency of the alternating current, a positive and a negative potential. This has the effect of causing an oxide layer to form on the aluminum strip, and for the greater part to redissolve again when the aluminum strip becomes the cathode. As such the dissolution of the approximately 0.05 μm thick oxide layer does not occur uniformly but locally so that craters are formed. These craters provide a suitable roughened base for adhesion of the subsequently deposited lacquer.

The object of the present invention is to develop a process which provides adequate adhesion for subsequently deposited lacquer, adhesive or laminating material, at least for the normal, present day requirements, and such that the surface layer formed on the aluminum is free of heavy metals. Furthermore the pretreatment should be continuous, and faster than the conventional process.

SUMMARY OF THE INVENTION

This object is achieved by way of the invention in that a strip or foil is subjected in an electrolyte to the effects created by a three-phase current, one phase of which is rectified, and by passing the side of the strip or foil to be treated under at least three sequentially arranged electrodes, of which at least one, preferably the middle one, is connected to the rectified phase, while the others are connected to the alternating phases.

It was found that oxide layers can be produced in a sulphuric acid electrolyte in a facility having three counter electrodes which are insulated from the aluminum strip to be treated and which are each connected to one phase of a three phase current, and such that the lacquer adhesion is equal to or better than is the case with chromate coatings, in particular when the strip to be treated is connected to the null-phase. The use of the three phase current alone does not, however, produce an accelerated formation of the oxide layer.

The invention is based on the knowledge that, on rectifying one or two phases of the three phase current during the treatment of an aluminum strip, a displacement towards the more pronounced formation of the oxide layer takes place at the expense of the dissolution of the already formed oxide layer. Thus the crater-forming dissolution of the oxide film, necessary for good lacquer adhesion, takes place, but without reaching down to the underlying metal. As a result of the oxide layer remaining in the lower part of the crater better corrosion resistance is achieved. This is extremely important especially for packaging corrosive substances, and for example results in such a treated strip having a better resistance to sterilization conditions when made into forms of packaging.

The electrochemical events taking place at the electrodes and on the strip, especially when rectifying one or two phases, are apparently complicated and not yet fully explained.

BRIEF DESCRIPTION OF THE DRAWINGS

Further advantages, features and details of the invention are revealed with the help of the following description and the drawings viz.

DETAILED DESCRIPTION

Figure 1:
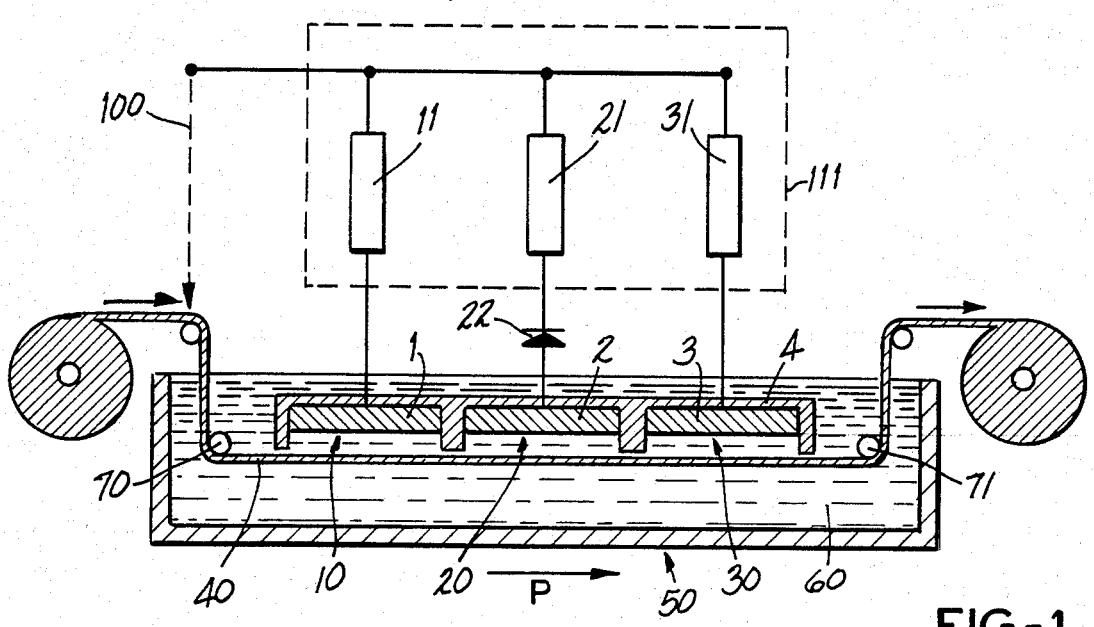
FIGS. 1 to 3: Schematic cross section of the arrangement of the electrodes and aluminium strip

FIG. 1 shows a tank which contains an electrolyte 60 with electrodes 1, 2, 3 dipping in to it; also shown is an aluminum strip 40 which moves over deflecting rolls 70 and 71 and below electrodes 1, 2, 3. The electrodes are embedded in a supporting frame 4 of electrically insulating material in such a manner that only the electrode surfaces 10, 20, 30 facing the metal strip 40 are not insulated. The walls of the frame 4 facing the strip 40 and between the electrodes 1, 2, 3 project beyond the electrode surfaces 10, 20, 30, and extend as close as possible to the surface of the strip, but without touching it. The electrodes 1 and 3 are connected directly to the windings 11 and 31, respectively, of the three phase transformer 111, and electrode 2 to the winding 21 via a diode 22. The process is such that the current flows between the three electrodes via the metal strip 40, which is as a result oxidized. It is particularly important for the null phase conductor 100 to be connected to the aluminum strip, if the electrode surfaces 10, 20, 30 project considerably beyond the breadth of the strip 40. The direction of movement of the metal strip 40 is indicated by the arrow P.

Figure 2:
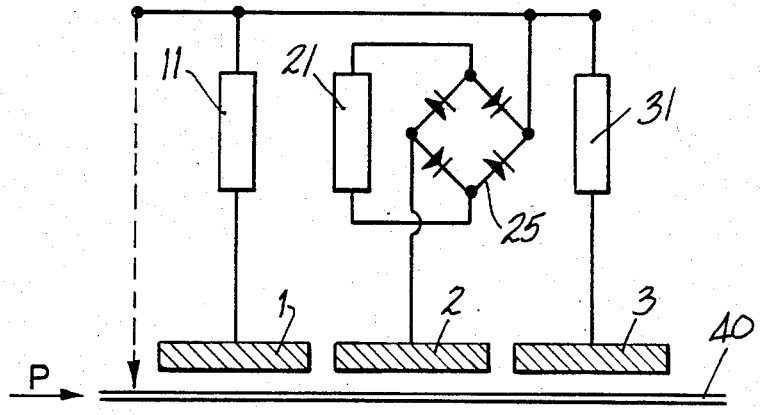
Figure 3:
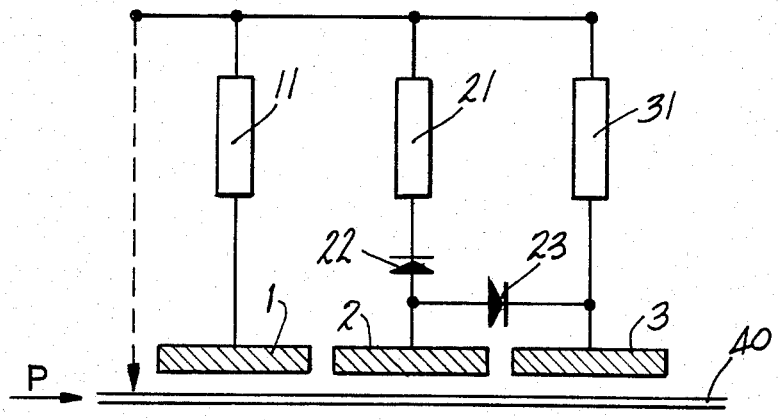

For simplicity and clarity the tank with the electrolyte and the alignment means for the strip are not shown in FIGS. 2 and 3. In FIG. 2 the arrangement is the same as in FIG. 1 except that a Graez rectifier 25 is employed at electrode 2 instead of the diode 22. FIG. 3 shows the same arrangement as in FIGS. 1 and 2 except that a further diode 23, which connects the middle electrode 2 with electrode 3, is provided. For double sided oxidation of the metal strip the same electrode system 1, 2, 3 and 4 is provided facing the lower side of the strip and such that the individual electrodes are connected parallel with the upper electrodes.

In the case of electrode 1, which mainly has the function of degreasing the strip, rectifying the first phase both in the positive and in the negative direction produces results which are somewhat poorer then when this phase is not rectified. A possible explanation for this is that on changing the positive and negative half waves of the current the oxide made up of undefined oxides and traces of rolling lubricant are more effectively distroyed and dissolved than when they are exposed only to the dissolution effect of a negative potential. Also in the process the basis for the oxide skin is formed, and then destroyed in the subsequent two steps.

In the region of electrode 2 the oxide layer on the aluminum strip is strengthened if the second phase is connected to this electrode via a rectifier in such a way that the electrode mainly has a negative potential and the strip mainly a positive potential. Trials showed that it is advantageous to rectify this phase to a pulsed direct current via a diode, as shown in FIG. 1, instead of via a Graetz rectifier 25, even though that also provides very good results. It is further advantageous to connect the middle electrode 2, via a like polarized diode 23, also to the third phase of electrode 3. Here too the electrochemical events taking place cannot be fully explained but it is assumed that, as a result of the frequency shift, potential differences arise between the two phases while a part of the negative half-wave of current of the third phase of electrode 3 flows to the middle electrode 2, and in contrast to this the positive potential at the third electrode 3 rises.

The third electrode 3, with or without connecting the diode 23 to the middle electrode 2, causes the crater type dissolution of the oxide layer to terminate. If the phase at the connected electrode 3 is rectified in such a manner that the metal strip only has a negative potential, in order to induce more pronounced dissolution of the oxide layer, the switching over induces more of a fissuring of the oxide layer than a pure dissolution, even with pulsed negative potential.

In trials using a sulphuric acid electrolyte (10–30% conc.) and otherwise normal operating conditions, it was found that in order to obtain the necessary adhesion with the oxide layer it was advantageous to heat the bath to at least 50° C. All the examples described in the following were however carried out at a temperature of 90° C. as it turned out that under that condition the oxide skin formed faster and exhibited excellent adhesive properties. Furthermore, it was found that the oxide formed in a 10–30% sulphuric acid solution, in particular in the range 15–20%, is especially suitable for subsequent lacquering.

EXAMPLES

In order to test the adhesive strength provided by the oxide layer, the oxidized aluminum strips were lacquered with a 1/10 mm thick layer of epoxy-phenolic lacquer in such a manner that after stoving at 205° C. a lacquer layer 6–7 μm thick was obtained. The test strips were then divided up and, using a polyamide foil, put together such that each side of polyamide foil came in contact with a lacquer surface. With the samples made up in such sandwich form the composite was then sealed for 1 second at 220° C. transverse to the rolling direction and cut into 15 mm wide test pieces. Half of the samples were then sterilized 20 minutes at 121° C. in distilled water.

Using the peel test, peeling at an angle of 180° with an Instron tensile machine, it was possible to determine the adhesive strength of the lacquer as in each case separation of the lacquer from the metal occurred and not fracture due to cohesion. The results were compared with the average peel strength value, 16N/15 mm, with sterilized samples having chromate treated surfaces.

Figure 4:
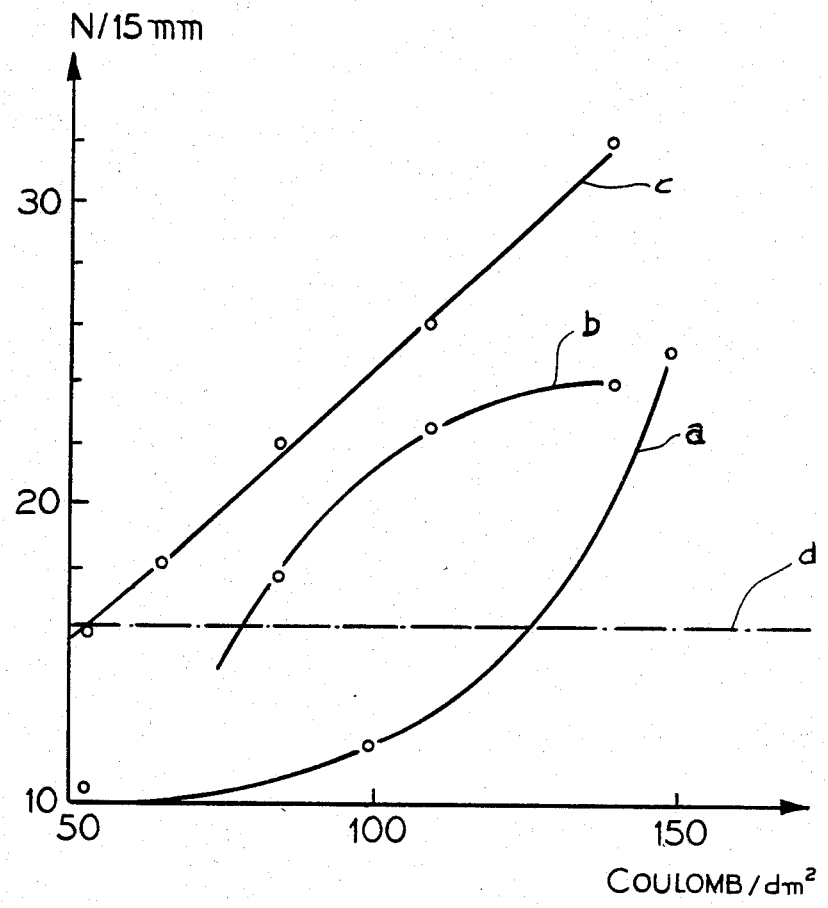
FIG. 4: Strength of adhesion values obtained via the process according to the invention and compared with values from a state of the art method.

Tests were also made with different forms of current under otherwise constant test conditions, 5 seconds treatment time, 15–20% sulphuric acid electrolyte, oxidized at 90° C., the samples being finally lacquered and then adhesion tested. The results of these tests are indicated in FIG. 4 as a function of the current density. These show:

Curve a the results obtained with a single phase alternating current.

Curve b the results obtained with three phase alternating current without rectification.

Curve c the results obtained with three phase alternating current and partial rectification using the arrangement shown in FIG. 3, and Curve d the results obtained with a normal conversion coating (chromate treatment, stabilized).

It can be seen from the curves that for the same adhesion using alternating current over 130 coulombs of electricity are required whereas 75 coulombs are adequate using three phase alternating current. If, however, the phase for the middle electrode 2 is rectified with a diode 22, and a part of the current for the last electrode is passed to the middle electrode 2 likewise via a diode 23, a degree of adhesions of lacquer is achieved which is much superior to that obtained by state of the art method.

Similar good test results were obtained with adhesion and laminating trials using the process according to the invention.

The process according to the invention thus enables strips and foils of aluminum to be manufactured for sterilizable packaging without the use of hexavalent chromium containing conversion coatings. In addition the time for pretreatment is reduced to a third to one quarter of the time necessary for pretreatment using chemical processes.

A significant improvement in lacquer adhesion over that obtained with only chemically degreased foil for non-sterilizable packaging is achieved already at a current density of only 10 coulombs/$dm^2$, so that the process can also replace conventional degreasing.

What is claimed is:

1. A process for pretreating an aluminum strip or foil by means of electrochemical oxidation for subsequent coating of same which comprises: providing an aluminum strip or foil; subjecting at least one side of said aluminum strip or foil to an electrochemical oxidation in a single electrolyte wherein said aluminum is subjected to a three phase alternating current, one phase of which is rectified, and said side passes sequentially three electrodes of which at least one is connected to the rectified phase while the others are connected to the other phases of the alternating current.

2. A process according to claim 1 wherein the middle electrode is connected to the rectified phase.

3. Pretreatment of aluminum according to claim 1 wherein the aluminum is connected to a null-phase conductor.

4. Pretreatment of aluminum according to claim 1 wherein the current density on said side subjected to the three phase alternating current is at least 10 coulombs/$dm^2$.

5. Pretreatment of aluminum according to claim 1 wherein the rectified phase is rectified such that the electrode connected to it is at a negative potential and the aluminum at a positive potential.

6. Pretreatment of aluminum according to claim 5 wherein the rectified phase is rectified with the help of a diode.

7. Pretreatment of aluminum according to claim 1 wherein the electrode carrying the rectified phase has connected to it another electrode via a diode such that said diode allows through the negative half-wave of the alternating current phase in the direction of the electrode carrying the rectified current.

8. Pretreatment of aluminum according to claim 7 wherein the electrode carrying the rectified phase is connected to the last electrode.

9. Pretreatment of aluminum according to claim 1 wherein the electrolyte contains 10–30% sulphuric acid and is at a temperature of at least 50° C.

10. Pretreatment of aluminum according to claim 9 wherein the electrolyte contains 15–20% sulphuric acid and is at a temperature of about 90° C.

11. Pretreatment of aluminum according to claim 1 wherein the pretreatment is carried out continuously.

12. Pretreatment of aluminum according to claim 1 wherein said treated aluminum is subsequently coated by lacquering.

13. Pretreatment of aluminum according to claim 1 wherein said treated aluminum is subsequently coated by adhesive coating.

14. Pretreatment of aluminum according to claim 1 wherein said treated aluminum is subsequently coated by laminating.

* * * * *

UNITED STATES PATENT AND TRADEMARK OFFICE

CERTIFICATE OF CORRECTION

PATENT NO. : 4,534,834

DATED : August 13, 1985

INVENTOR(S) : Zdenek Maly

It is certified that error appears in the above-identified patent and that said Letters Patent are hereby corrected as shown below:

On the Cover Page, Under the Heading "Inventor", please change same to read as follows:

--[75] Inventor: Zdenek Maly, Kreuzlingen, Switzerland--.

In the Abstract, line 1, delete "(40)".

Column 1, line 19, after "pretreat" delete "of".

Column 1, line 30, after "resistance" insert --,--.

Signed and Sealed this

*Twenty-sixth* Day of *November 1985*

[SEAL]

*Attest:*

DONALD J. QUIGG

*Attesting Officer*

*Commissioner of Patents and Trademarks*